US008011046B2

(12) United States Patent
Stjerna

(10) Patent No.: US 8,011,046 B2
(45) Date of Patent: Sep. 6, 2011

(54) POCKET SPRING MATTRESS

(75) Inventor: Nils Eric Stjerna, Herrljunga (SE)

(73) Assignee: Stjernfjadrar AB, Herrljunga (SE)

( * ) Notice: Subject to any disclaimer, the term of this patent is extended or adjusted under 35 U.S.C. 154(b) by 716 days.

(21) Appl. No.: 12/086,385

(22) PCT Filed: Mar. 8, 2007

(86) PCT No.: PCT/SE2007/000219

§ 371 (c)(1),
(2), (4) Date: Jun. 12, 2008

(87) PCT Pub. No.: WO2007/102772

PCT Pub. Date: Sep. 13, 2007

(65) Prior Publication Data

US 2010/0212090 A1 Aug. 26, 2010

(30) Foreign Application Priority Data

Mar. 8, 2006 (SE) ..... 0600502

(51) Int. Cl.
*A47C 25/00* (2006.01)

(52) U.S. Cl. ..... 5/720; 5/655.8

(58) Field of Classification Search ..... 5/716, 720, 5/655.8, 654.1; 267/80, 89, 91; 29/446
See application file for complete search history.

(56) References Cited

U.S. PATENT DOCUMENTS

| | | | | |
|---|---|---|---|---|
| 1,719,553 | A | 7/1929 | Kaspar | |
| 1,873,212 | A | 8/1932 | Ostroff | |
| 2,878,012 | A | 3/1959 | Crites | |
| 5,467,489 | A * | 11/1995 | Cchen | 5/720 |
| 7,636,972 | B2 * | 12/2009 | Mossbeck et al. | 5/720 |
| 2004/0025257 | A1 | 2/2004 | Ahlqvist | |
| 2009/0320269 | A1 * | 12/2009 | Mossbeck et al. | 29/446 |

FOREIGN PATENT DOCUMENTS

| | | |
|---|---|---|
| JP | 2001-340175 | 12/2001 |
| JP | 2004-041602 | 2/2004 |

* cited by examiner

*Primary Examiner* — Fredrick Conley
(74) *Attorney, Agent, or Firm* — Harness, Dickey & Pierce, PLC

(57) ABSTRACT

A spring mattress for beds is disclosed. In at least one embodiment, the spring mattress includes a plurality of strings which are interconnected side by side and include a continuous casing material with a plurality of separate pockets with coil springs enclosed therein. Moreover the casing material for at least some pockets is at least substantially airtight, thus providing a resistance to air being pressed out when the springs of the mattress are loaded, which, when subjected to a uniform load during a transition period, results in a gradually increasing depression of the spring to its depressed state. This results in a comfortable mattress, into which the user sinks gradually and which thus is comfortable and safe and allows the user to move easily. A corresponding method and device for manufacturing such a mattress are also described.

19 Claims, 5 Drawing Sheets

POCKET SPRING MATTRESS

FIELD OF THE INVENTION

The present invention relates to a spring mattress comprising springs enclosed in casings, referred to as a pocket mattress, as well as a method and a device for manufacturing thereof.

BACKGROUND ART

A common technique of making spring mattresses is the so-called pocket technique. This means that the springs are enclosed in pockets, that is they are individually surrounded by a casing material. In this way, the springs will be relatively individually resilient so that they can flex individually without affecting the neighbouring springs and, thus, the comfort of the user increases since his weight will be distributed more uniformly over the surface that receives the load.

A drawback of this type of mattresses is, however, that they are often relatively soft, which makes it difficult to move in the bed as the user is to turn or sit up in the bed for instance. Moreover, there is a risk of falling out of the bed when lying close to the edge or when sitting down on the edge, which may cause injuries and discomfort.

For example GB 225 225, U.S. Pat. No. 2,878,012 and U.S. Pat. No. 2,359,003 also disclose cushions to be used as vehicle seats with coil springs, where surrounding casings are airtight and check valves or the like are provided to limit the flow of air into the casings. As a result, damping is provided, which makes the returning of the coil springs to an extended position difficult, which reduces swinging and oscillation when the vehicle drives over an uneven road and the like. These cushions are, however, neither intended nor suitable for use in beds and are besides of another type than conventional pocket mattresses, comprising separate enclosed spring units which are widely scattered in the mattress.

Moreover U.S. Pat. No. 5,467,489 suggests a pocket mattress where coils springs are enclosed in airtight casings and where check valves are arranged in the bottom and exhaust passages at the top. This results in an airflow through the mattress, which gives a cooling effect to the user. However, no damping is achieved. Also this mattress is of another type than conventional pocket mattresses, comprising separate pocket units which are interconnected by flexible links.

There is thus a need for a pocket mattress which can be made soft and comfortable and still allow the user to move relatively easily and where the risk of the user falling out of the bed is reduced. There is also a need for a pocket mattress which, while maintaining the positive properties of pocket mattresses in general, also has certain properties that remind of mattresses of visco-elastic materials, such as an initially slow sinking into the mattress when laying down on it. It is also desirable that a mattress with the above-mentioned properties can be manufactured relatively easily and cost-effectively.

OBJECT OF THE INVENTION

It is therefore an object of the present invention to provide a spring mattress of the type mentioned by way of introduction, as well as a method and a device for manufacturing the same, in which the above related drawbacks are eliminated wholly or at least partly.

This object is achieved by a spring mattress, a method and a device for manufacturing the same according to the claims.

SUMMARY OF THE INVENTION

According to one aspect of the invention, a spring mattress for beds is provided, comprising a plurality of strings interconnected side by side, said strings comprising a continuous casing material with a plurality of separate pockets with coil springs enclosed therein, wherein the casing material for at least some pockets is at least substantially airtight and a resistance is provided to air being pressed out when the springs of the mattress are loaded, which, with a uniform load during a transition period, results in a gradually increasing depression of the spring to its depressed state.

By the casing material being airtight or substantially airtight so that there is a resistance to air penetrating through the material, air can enter the pockets and escape from them, but with a resistance so that this does not occur instantaneously, but slowly over a certain period of time. This can be achieved by, for example, using absolutely tight casing materials in which holes or perforations are arranged to allow an adequate airflow, or by using a not completely airtight material, which itself affords adequate damping of the airflow. By choosing a suitable permeability of the material and/or a suitable number and dimension of the holes, the damping provided can be controlled to a suitable level.

With the construction according to the invention, the air cushion will be filled in an unloaded state by the enclosed spring expanding the material. When the spring is subjected to a load, the air cushion will first absorb most of the force, and air will be pressed out of the pocket. Due to the flow resistance, this will, however, not occur instantaneously, but gradually during a transition period. As the air gradually leaves the pocket, the spring will absorb more and more of the loading force and then finally absorb the entire force. This results in initial damping and an initial resistance when subjected to a load, which then gradually decreases with the continuing load. This makes it easy, for example, to move in the bed and safely, for example, sit down on the edge of the bed. At the same time the mattress soon, for instance after a few seconds, returns to its spring-loaded, normal state, which means that there is no negative effect on the comfort of the user.

In this way, the user experiences the same feeling as when using mattresses of visco-elastic materials, such as Tempur® mattresses, where the mattress offers an initial resistance and where the user then slowly sinks into the mattress to be surrounded by the same. However, such visco-elastic mattresses suffer from several drawbacks, such as a great temperature dependence of the mattress properties and a tight surface of the mattress. In the mattress according to the invention, the above-mentioned properties are, however, combined with positive features of pocket mattresses, such as airflow through the mattress, which makes it cool and pleasant to use. Furthermore the mattress properties are quite independent of, for instance, temperature, which results in the same mattress properties being obtained irrespective of the surroundings. This means that the mattress properties can already be controlled in manufacture and that they do not change in use.

The inventive mattress results in an advantageous initial resistance and a desirable slow sinking of the user into the mattress, while at the same time the mattress is air-permeable between the pocket springs, and has substantially fully temperature-independent properties. In the depressed-state, where the springs themselves support the entire weight of their user, the mattress further functions as a normal pocket mattress.

The transition period in which a gradually increasing depression of the spring to its depressed state occurs, is preferably in the range of 0.5-20 s, more preferred in the range of 1-15 s and most preferred in the range of 4-12 s, when the spring unit is subjected to a uniform load of 20 N.

Moreover, the casing material, including any perforations, has an air permeability, measured by a standard testing method, of from 0.15 $l/m^2/s$ to about 1.6 $l/m^2/s$, at a differential pressure of 100 Pa through the casing material.

In a preferred embodiment of the invention, the strings are arranged side by side by interconnection of the surfaces of the casing materials, preferably by gluing or welding. Further the pockets of the strings are preferably separated by welding.

According to one embodiment of the invention, it is possible to let all the pockets have the same resistance to air being pressed out when the springs of the mattress are subjected to a load. Alternatively, it is, however, possible to provide a mattress where some pockets are arranged to provide a resistance to air being pressed out when the springs of the mattress are loaded, which resistance is different from that of other pockets. In this way, it is possible to provide zones with different properties in the mattress. For instance, it is advantageous to arrange pockets in the vicinity of the edge of the mattress, which provide a resistance to air being pressed out when the springs of the mattress are loaded, which is greater than the resistance of pockets inwardly in the mattress. This means that the edge of the mattress will be initially harder, which reduces the risk of the user falling when sitting down on the edge of the bed, falling out of the bed and the like. It is also possible to arrange zones with different properties to obtain an adaptation to different parts of the user's body, so that for example parts subjected to a high load, corresponding to, for example, the user's shoulders and pelvis, offer less initial resistance than the other parts of the surface of the mattress.

Preferably the casing material is a weldable textile material.

The strings of the spring mattress preferably comprise a plurality of separate pockets which are delimited from each other in a relatively airtight manner. However, it is as an alternative possible for two or more neighbouring separate pockets of at least one of the strings to be delimited from each other in such a manner that a direct airflow between these separate pockets is allowed, for example by a duct or opening being provided between them.

According to a second aspect of the invention, a method is provided for manufacturing spring mattresses for beds, comprising the steps of providing a substantially airtight casing material;

enclosing coil springs (5) in separate pockets (4), which pockets are arranged in strings of continuous pieces of the casing material (3); interconnecting a plurality of strings (2) side by side; arranging, before or after the enclosing of the coil springs and the interconnecting of the strings, perforations through the casing material of at least some pockets. With this method, advantages are achieved corresponding to those discussed above with respect to the first aspect of the invention.

According to yet another aspect of the invention, a device is provided for manufacturing spring mattresses for beds, comprising means for enclosing coil springs (5) in separate pockets (4) in a substantially airtight casing material, the pockets being arranged in strings of continuous pieces of the casing material (3); means for interconnecting a plurality of strings (2) side by side; and means for arranging perforations through the casing material of at least some pockets. With this device, advantages are achieved, corresponding to those discussed above with respect to the first and the second aspect of the invention.

These and other advantages of the present invention will be evident from the following detailed description of specific embodiments.

BRIEF DESCRIPTION OF THE DRAWINGS

In the accompanying drawings

DESCRIPTION OF PREFERRED EMBODIMENTS

For the purpose of exemplification, the invention will now be described in more detail by way of an embodiment and with reference to the accompanying drawings.

Figure 1:
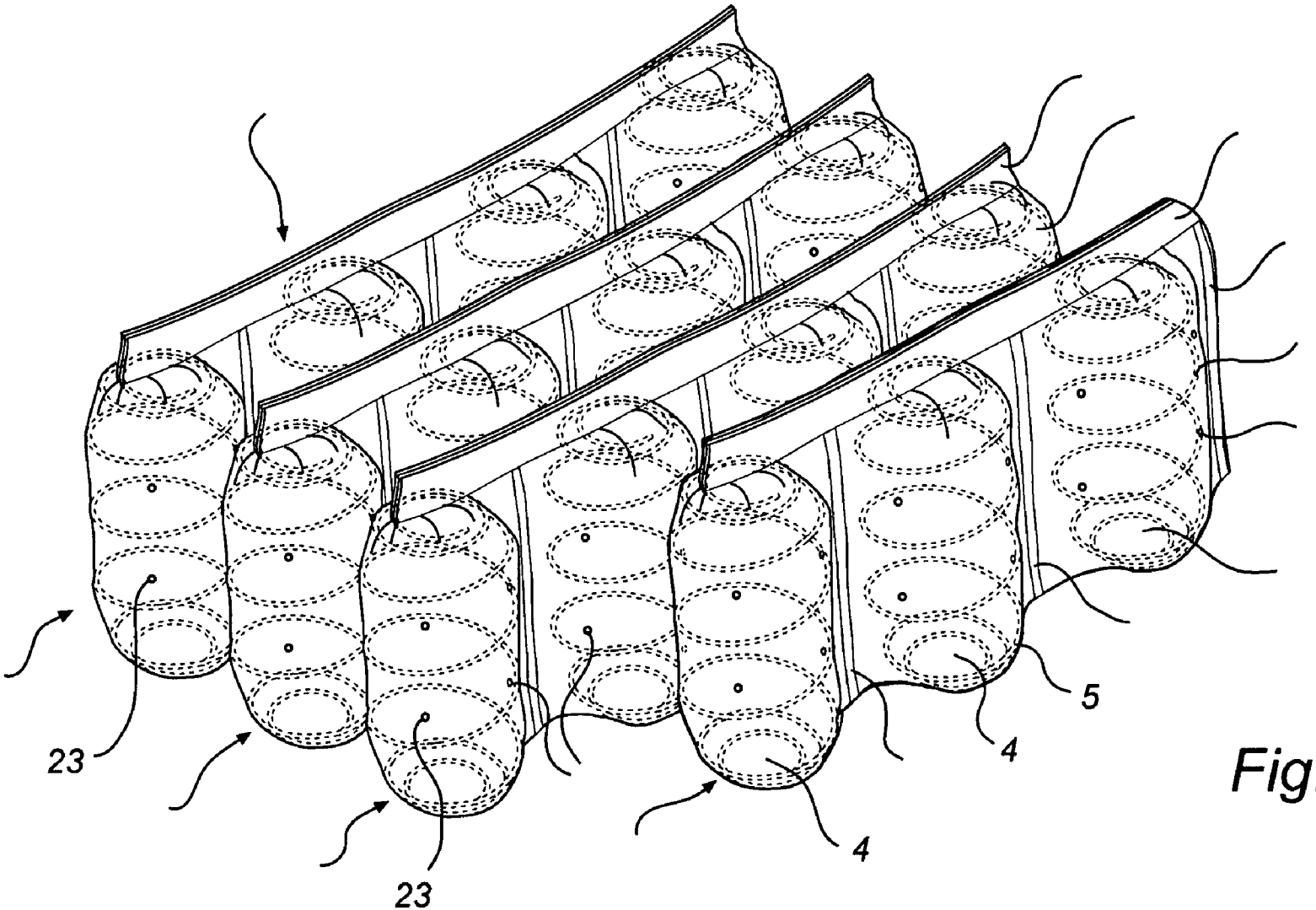
FIG. 1 is a perspective view, seen obliquely from above, of part of a mattress according to an embodiment of the invention.

A spring mattress 1 according to the invention comprises, as shown in FIG. 1, a plurality of strings 2 which are interconnected side by side. The strings are made of a continuous casing material 3, with a plurality of separate pockets 4 arranged in the same. Coil springs 5 are enclosed in the pockets.

The strings 2 can advantageously be made by a casing material being folded around the springs, and connecting lines, such as welds, glue strings or the like, being arranged both in the longitudinal direction of the strings—longitudinal connecting lines 21—and transversely to the longitudinal direction of the strings—transverse connecting lines 22—to delimit the springs from each other. This results in a separate pocket for each spring. Preferably the connecting lines 21, 22 are arranged so as a provide a tight delimitation between the pockets. However, it is also possible to let some of the transverse connecting lines 22 offer a certain airflow between the pockets delimited by them, which thus allows an airflow between two or more neighbouring pockets. The longitudinal connecting lines 21 can either be arranged above the ends of the enclosed springs, in a manner as illustrated in FIG. 1, or alternatively be arranged at the side of the springs.

Figure 2:
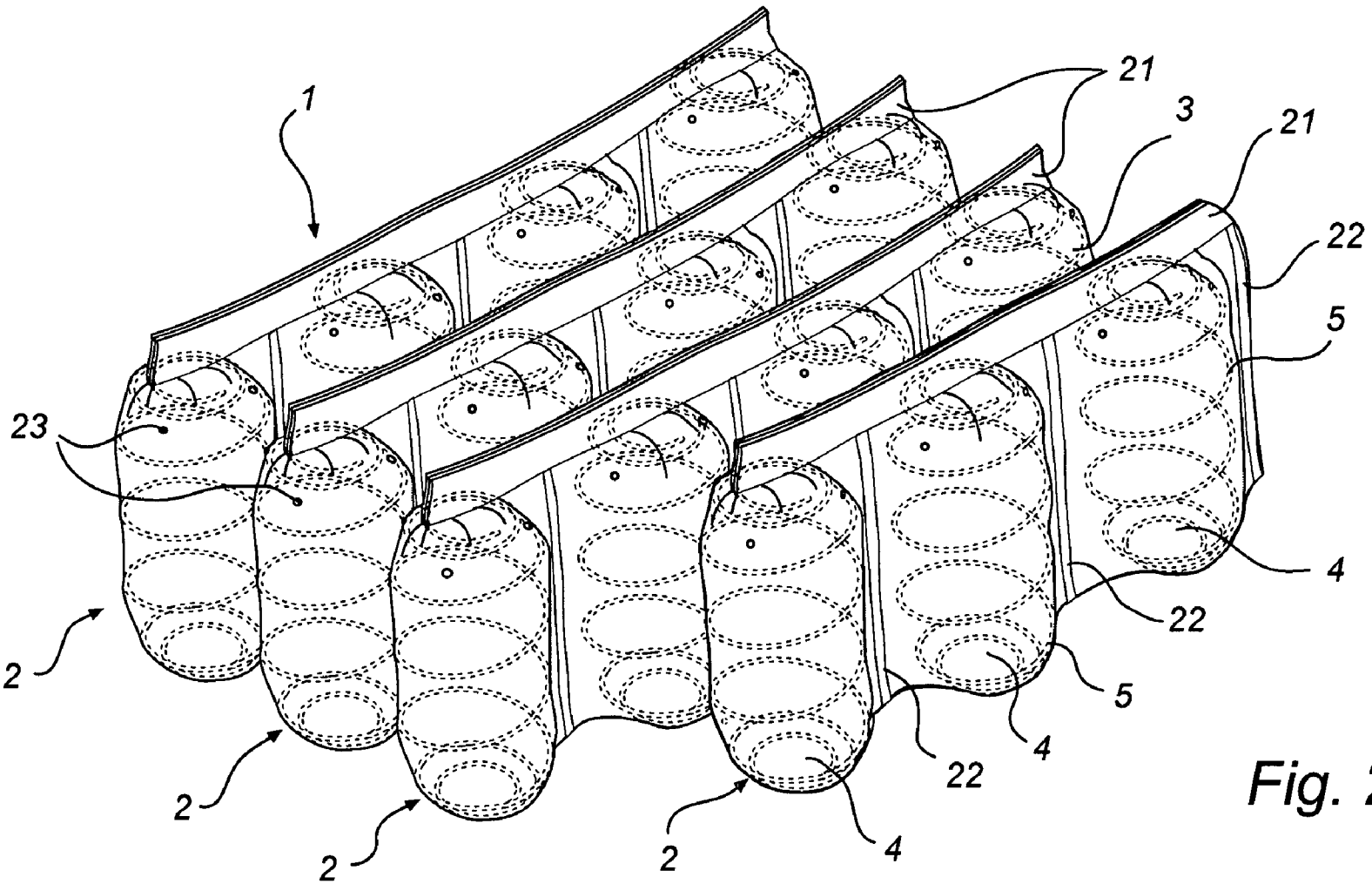
FIG. 2 is a perspective view, seen obliquely from above, of part of a mattress according to an alternative embodiment of the invention.

The strings of springs are further preferably arranged side by side, as indicated in FIGS. 1 and 2. Preferably, the strings are connected to each other by 2-3 vertically distributed fixing points just opposite of each spring. Of course, a smaller or greater number of fixing points is conceivable. It is also possible to arrange a longer fixing line substantially parallel to the longitudinal direction of the springs instead of a plurality of shorter fixing points. The connection of the strings to each other can occur by welding or gluing. However, the connection can alternatively occur by means of clamps, by Velcro tape or in some other suitable manner.

Preferably, the mattress as described above is manufactured by strings of interconnected pocket springs in casings first being manufactured automatically, after which these strings are cut in suitable lengths and joined to each other side by side to form mattresses.

Coil springs of many sizes can be used in connection with the present invention, and basically any size of springs can be used. However, it is preferred to use springs with a diameter of 1-10 cm, and most preferred about 6 cm. The springs comprise preferably at least three turns, and preferably less than 10 turns. Moreover they are advantageously made of spiral wire with a thickness in the range of 0.5-3.0 mm, preferably a thickness in the range of 1.25-2.50 mm.

The casing material for at least some pockets is further at least substantially airtight, and preferably the casing material for substantially all pockets of the mattress is at least substantially airtight. This can be achieved by using a material which is relatively airtight, but still has a certain air permeability, in which case a certain, limited airflow through the material is made possible. Preferably, however, a substantially fully airtight material is used, but with small perforations 23 or the like to allow a certain, limited airflow into and out of the pockets. Preferably, these holes or perforations 23 are arranged so as to open into the gaps occurring between neighbouring pocket units.

The casing material preferably comprises a sandwich material, comprising a supporting layer of a durable, and preferably weldable, material, and a sealing layer which is substantially airtight. The supporting layer can suitably be made of a textile material, while the sealing layer suitably can be made of some kind of synthetic material, such as polyurethane. However, it is alternatively possible to use a homogeneous material, which is both relatively durable and relatively airtight.

The casing material, in combination with the perforations, if any, preferably provides an air permeability which is sufficient to obtain the desired properties of the mattress, as discussed above. The average air permeability of the casing material, including any perforations, can be measured, for example, by a standard method, such as SS-EN ISO 9237: 1995, and with a differential pressure of 100 Pa through the casing material. The air permeability is in this case preferably in the range of 0.15-1.6 $l/m^2/s$, and most preferred in the range of 0.3-1.4 $l/m^2/s$.

The substantially airtight pockets result in a resistance to air being pressed out when the springs of the mattress are subjected to a load, which, with a uniform load during a transition period, results in a gradually increasing depression of the spring to its depressed state.

Figure 5:
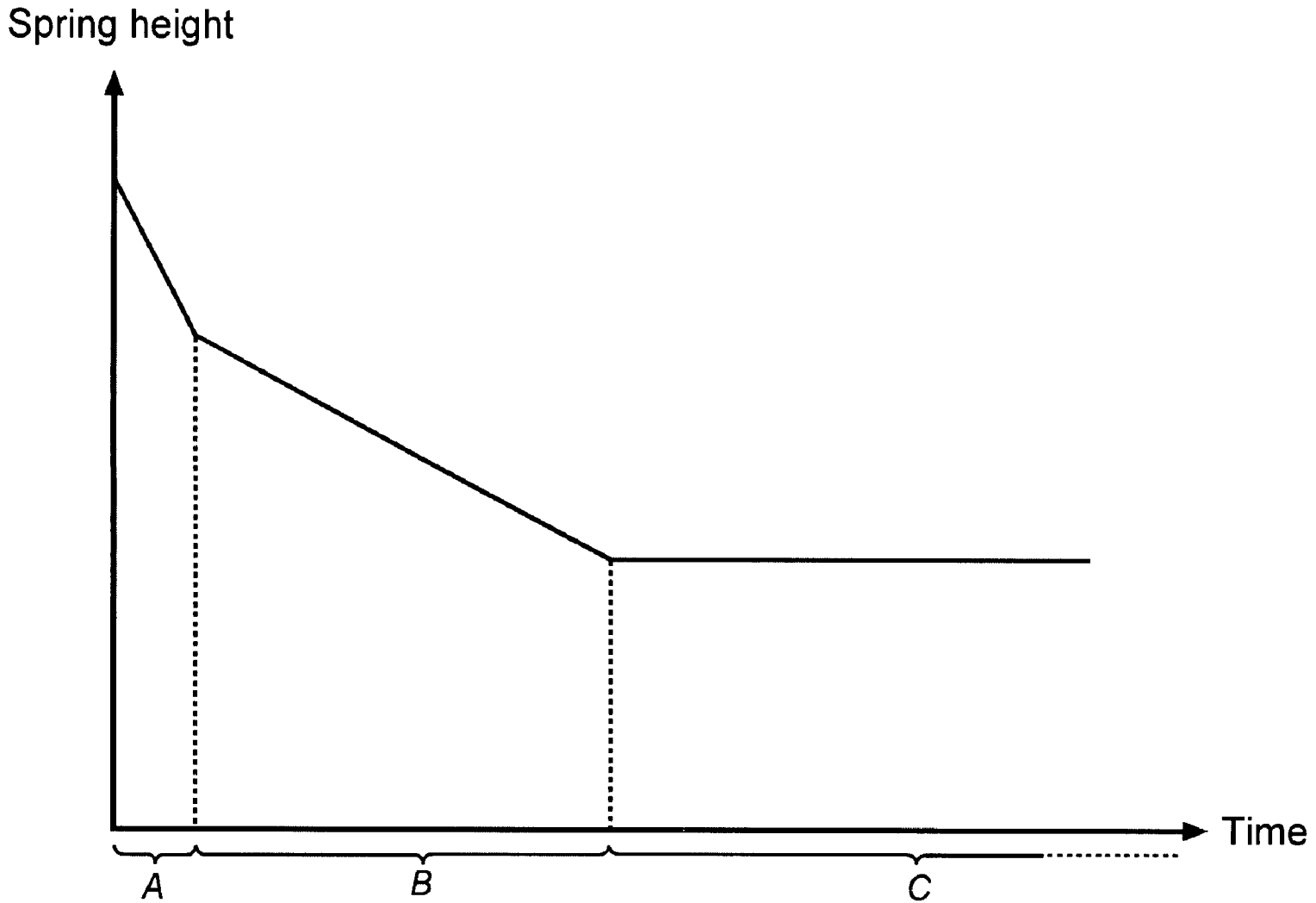
FIG. 5 is a schematic diagram indicating the ratio of spring height to time after subjecting a mattress according to the invention to a load.

The depression of a spring of the mattress as described above at a constant loading force is schematically illustrated in the diagram in FIG. 5. When the loading force is introduced, the spring is initially compressed relatively quickly, during a phase A, during which the air expands the side walls of the pocket and the spring absorbs substantially the entire depressing force. The depression occurring during this phase can be controlled, for example, by adaptation of the size of the casing of the pockets etc. After this initial depression, the enclosed air expands the pocket and prevents further depression, and after that depression occurs relatively slowly while the air is being pressed out through the perforations of the pocket and/or through the slightly air-permeable casing material. During this phase B a slow reduction of the height of the spring takes place, while the air cushion forming in the pocket absorbs at least some of the loading force. Eventually, so much air has been pressed out that the spring absorbs substantially the entire depressing force. In this situation, no further air flows out of the pocket, nor does further compression of the spring take place. This state of equilibrium is in FIG. 5 designated phase C.

The transition from the spring being subjected to a load until the state of equilibrium (phase C) is achieved is due to several factors, such as the air permeability of the casing material, the number and size of perforations, if any, the size of the depressing force, the size of the spring etc. However, these parameters are suitably selected so that in normal use, with the spring unit subjected to a load in the range of 20 N, the transition time amounts to a period in the range of 0.5-20 s, preferably in the range of 1-15 s, and most preferred in the range of 4-12 s. This transition time consists almost exclusively of phase B as discussed above, while phase A takes place so quickly that in terms of time it is substantially negligible in the context.

In the embodiment according to FIG. 1, the perforations 23 are arranged substantially in the centre of the circumferential surfaces of the spring units, but radially arranged so as not to be positioned just in front of neighbouring spring units. This embodiment functions excellently for most mattresses, and results in a well-balanced airflow into and out of the mattress. However, many alternative locations of the perforations 23 are conceivable. For example, such an alternative is illustrated in FIG. 2. In this embodiment, holes or perforations 23 are likewise arranged so as to open into the gaps that arise between neighbouring pocket units, but are also arranged in the upper side and/or the underside of the spring units, that is on or near the ends of the spring units. In the specific embodiment shown, the perforations are arranged in the upper side of the mattress. This embodiment is suitable, for instance, when the spring units are configured so that the spring turns in use can block the perforations when positioned just in front of these. In the embodiment in FIG. 2, this problem is effectively eliminated since here the perforations are arranged on casing portions which are arranged between spring turns of different sizes. Moreover the perforations are in the shown embodiment not arranged symmetrically scattered, but are offset toward the centre line of the string, preferably toward a longitudinal connecting line which is arranged there.

This is advantageous since for natural reasons some excess casing material is collected near this connecting line, which further reduces the risk of the perforations being blocked in use.

Figure 3:
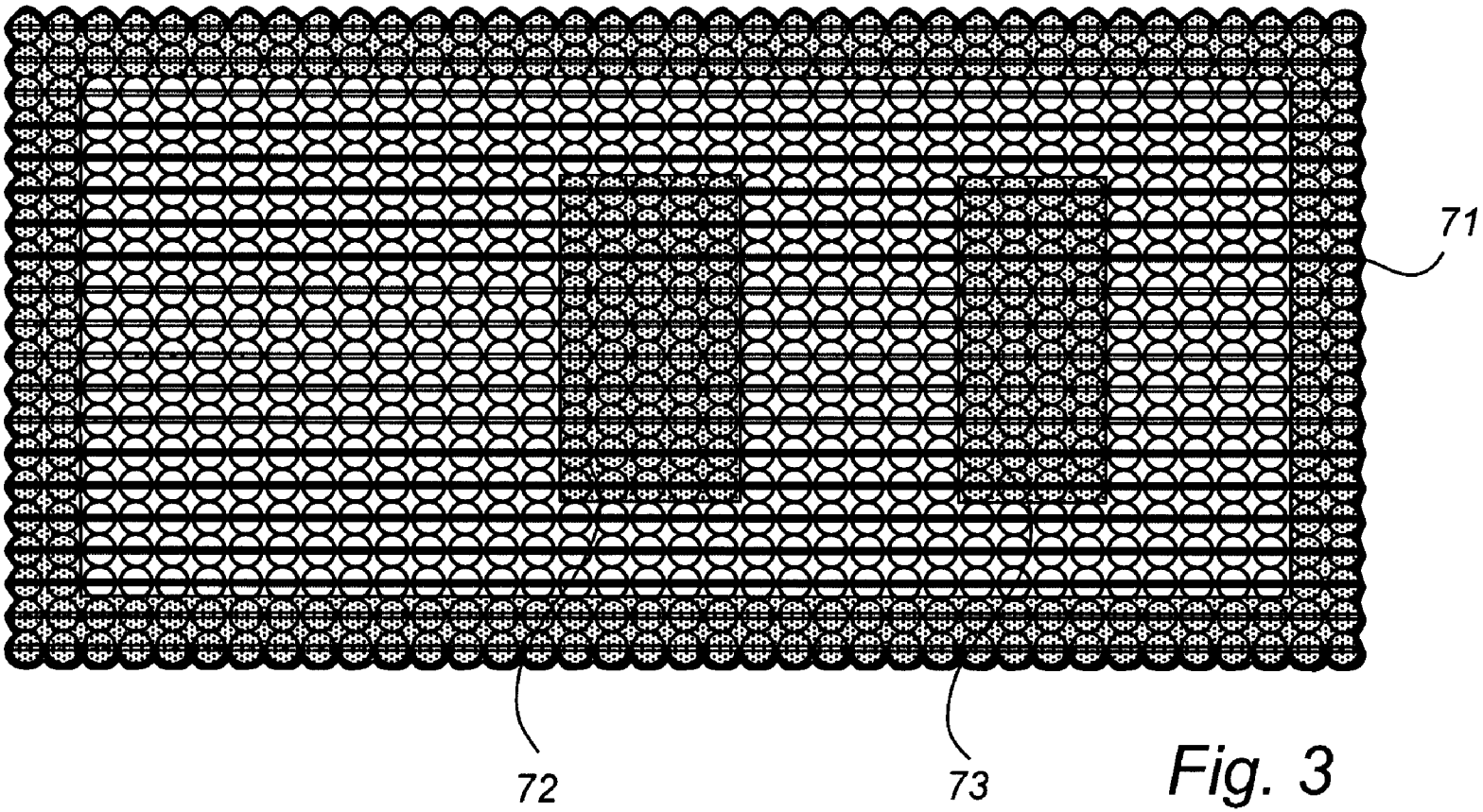
FIG. 3 is a top plan view of a mattress according to another embodiment of the invention, comprising zones with different properties.

It is also possible to use different pockets with different resistances to air flowing into and out of the pockets in different zones of the mattress. An example of a mattress with such different zones is illustrated in FIG. 3. In this embodiment, the pocket units in a zone 71 along the edge of the bed are configured to have a higher resistance to air flowing out of the pockets than the other pockets of the mattress. This reduces the risk of the user, for instance, falling out of the bed. Moreover, in this example two zones 72 and 73 are provided with pocket units, which are configured to have a lower resistance to air flowing out of the pockets than the other pockets of the mattress. Consequently, the portions of the mattress which in normal use are subjected to high loads, that is where the user's pelvis and shoulders are placed, will have less resistance to changes and will more quickly sink down to the depressed state of equilibrium when the user makes himself comfortable in the bed. However, it will be appreciated that many other divisions into zones over the mattress are possible. These zones have different transition times when subjected to a load until the state of equilibrium is achieved. In a special case, it is possible to let some zones have an almost non-existent resistance to air, such as in conventional pocket units, and/or have zones with an almost total resistance to air, where the pockets do not release the air, or release the air only very slowly, in which case supporting air cushions are formed at least during a longer transition time.

Figure 4:
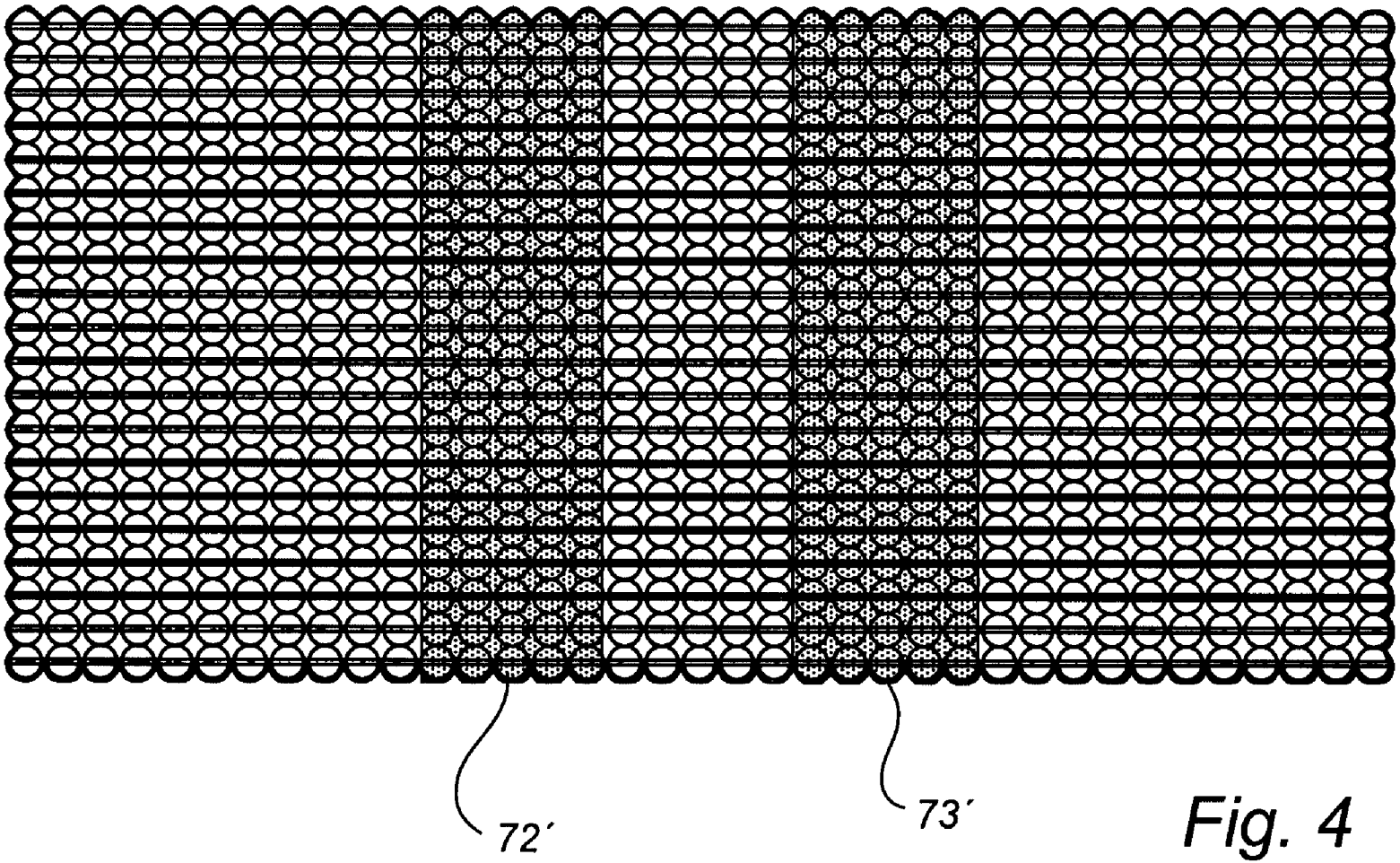
FIG. 4 is a top plan view of a mattress according to yet another embodiment of the invention, comprising zones with different properties.

An alternative division into zones is illustrated in FIG. 4. In this division into zones, two special zones 72' and 73' are provided with pockets units, which are configured to have a lower resistance to air flowing out of the pockets than the other pockets of the mattress, which zones are arranged to extend over substantially the entire width of the mattress. As a result, the portions of the mattress which in normal use are subjected to high loads, that is where the user's pelvis and shoulders are placed, will have a lower resistance to changes, and more quickly sink down to the depressed state of equilibrium when the user makes himself comfortable in the bed.

A division into zones is easy to make and adjust by changing, for example, the number or size of the perforations of the pockets. In this way, it is easy to provide different zones in different portions of the mattress, without necessitating any major changes in the manufacturing process. Manufacture will thus be very flexible and controllable and allows, for instance, easy individualisation and custom-design of the mattresses.

A device for manufacturing spring mattresses of the type described above comprises means for enclosing coil springs in separate pockets in a casing material in such a manner that the pockets are arranged in strings of continuous pieces of the casing material, and means for interconnecting a plurality of strings side by side. Many such means for manufacturing pocket units in strings and for interconnecting such strings are per se already well-known and therefore need not be described in more detail in this patent specification. Furthermore the manufacturing device preferably comprises means for arranging perforations through the casing material of at least some pockets. This perforating means may comprise, for example, one or more puncturing, cutting or burning tips, which are moved towards the casing material so as to make perforations of a suitable shape and size, and in the intended positions relative to the pockets that are formed or are to be formed. Conveniently the device is designed so that perforation occurs after the forming of the strings, that is in the completed pockets, but before connecting the strings to each other. However, it is also possible to perform the perforation after interconnecting the strings, or in the casing material even before the forming of the strings.

The invention has been described above by way of embodiments. However, several variants of the invention are conceivable. For example, as mentioned above, other types of fastening elements can be used to connect the strings to each other, as well as other casing materials, spring sizes, different divisions into zones etc. Such obvious variants must be considered to be covered by the invention as defined by the appended claims.

The invention claimed is:

1. A spring mattress for beds, comprising:

a plurality of strings interconnected side by side, said strings including a continuous casing material with a plurality of separate pockets with coil springs enclosed therein, at least some pockets being made of an at least substantially airtight casing material and arranged to provide a resistance to air being pressed out when the springs of the mattress are loaded, resulting, with a uniform load during a transition period, in a gradually increasing depression of the spring to its depressed state.

2. A spring mattress as claimed in claim 1, wherein the casing material is airtight and wherein at least one perforation is provided in each pocket.

3. A spring mattress as claimed in claim 1, wherein the casing material is air-permeable to a limited extent.

4. A spring mattress as claimed in claim 1, wherein the casing material, including any perforations, has an average air permeability, measured by a standard testing method, of from 0.15 $l/m^2/s$ to about 1.6 $l/m^2/s$, with a differential pressure of 100 Pa through the casing material.

5. A spring mattress as claimed in claim 1, wherein the transition period, during which a gradually increasing depression of the spring to its depressed state occurs, is in the range of 0.5-20 s, with the spring unit subjected to a uniform load of 20 N.

6. A spring mattress as claimed in claim 5, wherein the transition period, during which a gradually increasing depression of the spring to its depressed state occurs, is in the range of 1-15 s, with the spring unit subjected to a uniform load of 20 N.

7. A spring mattress as claimed in claim 5, wherein the transition period, during which a gradually increasing depression of the spring to its depressed state occurs, is in the range of 4-12 s, with the spring unit subjected to a uniform load of 20 N.

8. A spring mattress as claimed in claim 1, wherein the strings are arranged side by side by interconnection of the surfaces of the casing materials.

9. A spring mattress as claimed in claim 1, wherein the pockets of the strings are separated by welding.

10. A spring mattress as claimed in claim 1, wherein some pockets of the mattress are arranged to provide a resistance to air being pressed out when the springs of the mattress are loaded, which resistance is different from that of other pockets.

11. A spring mattress as claimed in claim 10, wherein pockets in the vicinity of the edge of the mattress are arranged to provide a resistance to air being pressed out when the springs of the mattress are loaded, which is greater than the resistance of pockets inwardly in the mattress.

12. A spring mattress as claimed in claim 10, wherein pockets with different resistances to air being pressed out when the springs of the mattress are loaded are arranged so that different zones are formed in the mattress.

13. A spring mattress as claimed in claim 1, wherein the casing is a weldable, textile material.

14. A spring mattress as claimed in claim 1, wherein the strings comprise a plurality of separate pockets which are delimited from each other in a relatively airtight manner.

15. A spring mattress as claimed in claim 1, wherein at least two neighbouring separate pockets of at least one of the strings are delimited from each other so as to allow a direct airflow between said separate pockets.

16. A spring mattress as claimed in claim 1, wherein the casing material comprises a textile material coated with a substantially airtight layer.

17. A spring mattress as claimed in claim 16, wherein the airtight layer comprises a plastic layer, such as a polyurethane layer.

18. A method of manufacturing spring mattresses for beds, comprising:

providing a substantially airtight casing material;

enclosing coil springs in separate pockets, the pockets being arranged in strings of continuous pieces of the casing material;

interconnecting a plurality of strings side by side; and arranging, before or after the enclosing of the coil springs and the interconnecting of the strings, perforations through the casing material of at least some pockets.

19. A device for manufacturing spring mattresses for beds, comprising:

means for enclosing coil springs in separate pockets in a substantially airtight casing material, the pockets being arranged in strings of continuous pieces of the casing material;

means for interconnecting a plurality of strings side by side; and means for arranging perforations through the casing material of at least some pockets.

* * * * *